United States Patent [19]

Hayes

[11] 4,089,364

[45] May 16, 1978

[54] MOLD HAVING INTEGRAL PREFORMED GATING SYSTEM

[75] Inventor: Douglas R. Hayes, Vernon, Conn.

[73] Assignee: United Technologies Corporation, Hartford, Conn.

[21] Appl. No.: 744,068

[22] Filed: Nov. 22, 1976

[51] Int. Cl.[2] ..... B22C 9/08

[52] U.S. Cl. ..... 164/363; 164/410

[58] Field of Search ..... 164/60, 244, 363, 362, 164/358, 360, 410; 249/109

[56] References Cited

U.S. PATENT DOCUMENTS

| | | | |
|---|---|---|---|
| 23,670 | 4/1859 | Gardiner | 249/109 X |
| 3,965,963 | 6/1976 | Phipps et al. | 164/60 |
| 3,991,810 | 11/1976 | Nieman | 164/363 X |

*Primary Examiner*—Robert L. Spicer, Jr.
*Attorney, Agent, or Firm*—Edward J. Timmer

[57] ABSTRACT

The present invention describes a preformed, multi-part casting mold having a preformed gating system integral therewith for providing smooth, bottom feeding of molten metal to the mold cavity while simultaneously removing contaminants from the metal prior to entry into the cavity. The improved mold is especially useful in casting columnar grained or single crystal metal and alloy articles, such as gas turbine blades.

4 Claims, 3 Drawing Figures

MOLD HAVING INTEGRAL PREFORMED GATING SYSTEM

BACKGROUND OF THE INVENTION

1. Field of the Invention

The present invention relates to the casting of high temperature metals and alloys and, more particularly, to molds for use in such processes.

2. Description of the Prior Art

The use of preformed, multi-part molds for casting high temperature metals and alloys, such as nickel base superalloys, is shown in U.S. Pat. Nos. 3,888,301; 3,927,710 and 3,965,963 all of which are assigned to the assignee of the present invention. These molds may be two part molds, including preformed opposed outer mold elements which define a mold cavity therebetween, or three or more part molds, including preformed outer elements with a central mold element or strongback therebetween, the elements defining mold cavities on opposite sides of the central element. The two part mold is generally used to make a unitary article whereas the three part mold is used to cast mating article shapes which are subsequently bonded together to form a finished product, an example of the latter being cast blade or vane halves which are bonded together to form a complete hollow turbine blade or vane. Regardless of the number of parts, the outer elements of these molds have projecting mating flanges on opposite edges by which flanges the outer elements may be clamped or otherwise held together in working relationship for casting.

Although the preformed, multi-part molds may be utilized in virtually any casting process, they are especially useful in casting columnar grained and single crystal metallic articles by the processes disclosed in VerSnyder U.S. Pat. No. 3,260,505 and Piearcey U.S. Pat. No. 3,494,709. Typically in such processes, molten metal is introduced into the preformed, multi-part mold via a pour cup either permanently or temporarily affixed to the top portion of the mold above the mold cavity or cavities, the molten metal being allowed to flow or cascade downwardly in the mold against a chill plate on which the mold rests. However, introduction of metal in this manner is disadvantageous in several ways. First, such top feeding or pouring of the molten metal directly into the mold causes severe turbulence and can lead to rather severe erosion of the mold walls and strongback. Such erosion not only may adversely affect the dimensional features of the mold elements but also may introduce numerous ceramic particulate inclusions into the molten metal and eventually into the solidified casting where the inclusions are harmful to the mechanical and other properties of the casting. Second, no means are provided for flushing or otherwise removing such particulate inclusions or those which might be present originally in the mold in the form of dust, dirt and the like. Third, top feeding of the molten charge into the mold may cause breakage of the preformed strongback as a result of the sudden force of molten metal impingement thereagainst. Fourth, there is little opportunity for controlling the metal flow characteristics, including flow rate, as the mold is being filled, thereby making attainment of the desired grain nucleation and orientation more difficult. In general, these and other problems associated with the top feeding of molten metal cause reduced yields and increase the cost of casting.

SUMMARY OF THE INVENTION

It is an object of the present invention to provide an improved preformed, multi-part mold for casting high temperature metals and alloys.

It is another object of the invention to provide improved control of molten metal flow during filling of the mold.

It is still another object of the invention to significantly reduce the amount of nonmetallic inclusions and other contaminants in the casting, thereby increasing yield and decreasing costs.

An important feature of the present invention is a preformed, multi-part mold having preformed gating means integral therewith for providing smooth, bottom feeding of molten metal to the mold cavity and for removing contaminants from the molten metal prior to entry into the cavity. In the practice of the invention, a preformed, multi-part mold having outer mold elements with projecting mating flanges on opposite edges is utilized. According to one embodiment, at least one pair of the mating flanges has preformed inner mating surfaces which define a gating system therebetween when the flanges are held in working relationship for casting. Typically, the gating system includes an ingate channel in communication at one end with the bottom portion of the mold cavity, the ingate channel extending from the cavity in the direction of flange projection and including along its length trap means for removing nonmetallic inclusions and other contaminants from the molten metal before entry into the bottom portion of the cavity. Intersecting and in communication with the other end of the ingate channel is a sprue channel extending upwardly to the top of the mating flanges for receiving molten metal from a pouring cup or the like permanently or temporarily positioned atop the flanges. The sprue channel is provided with a reduced cross section along its length to effect control of metal flow, including flow rate, so as to minimize turbulence and consequent erosion as the metal flows into the ingate channel and mold cavity.

The invention is particularly advantageous in that molten metal can be fed to the bottom portion of the mold cavity in a smooth and controlled manner while contaminants are being simultaneously removed therefrom. The absence of significant turbulence upon entry of the metal into the cavity provides optimum conditions for desired grain nucleation and growth in addition to minimizing erosion and generation of nonmetallic inclusions. Controlled bottom feeding of molten metal also significantly reduces, if not eliminates, breakage of the central mold element or strongback in a three part mold, since there is no sudden, forceful impingement of metal thereagainst. Also, the internal mold and gating surfaces may be visually inspected prior to assemblage to assure that properly dimensioned passages and cavities are provided.

These and other advantages and objects of the present invention will appear more fully from the following drawings and description of preferred embodiments.

DESCRIPTION OF THE PREFERRED EMBODIMENT

Figure 1:
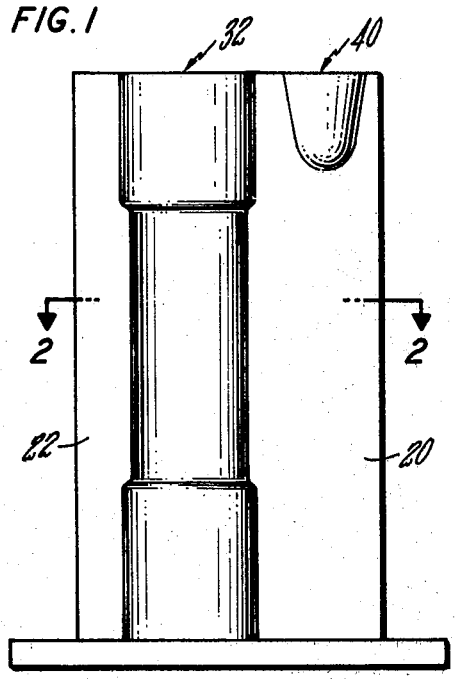
FIG. 1 is an elevation of a mold of the invention.
Figure 2:
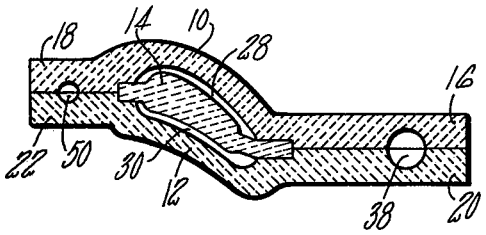
FIG. 2 is a cross-sectional view along line 2—2 of FIG. 1.

Referring first to FIGS. 1 and 2, a preformed, three-part mold useful for making the opposed blade halves of a turbine blade is shown by way of example. The mold includes preformed outer mold elements 10 and 12 of a suitable ceramic material and a preformed central mold element or strongback 14 also of a ceramic material. Outer mold element 10 has projecting flanges 16 and 18 along opposite edges thereof while outer element 12 has similar flanges 20 and 22. As explained in U.S. Pat. No. 3,965,963, the mating flanges 16 and 20 and 18 and 22 cooperate to position the strongback in proper relation therebetween. As shown in FIG. 2, the outer mold elements in conjunction with the strongback form blade half cavities 28 and 30 on opposite sides of the strongback. The outer mold elements are preformed to also define complementary portions of a riser cavity 32 above the blade half cavities and common thereto and complementary portions of a growth or crystal selector cavity 34 below the blade half cavities and common thereto, FIG. 3. In the embodiment illustrated, the growth cavity which opens onto chill plate 35 during casting acts to establish columnar grain growth as described in VerSnyder U.S. Pat. No. 3,260,505.

Figure 3:
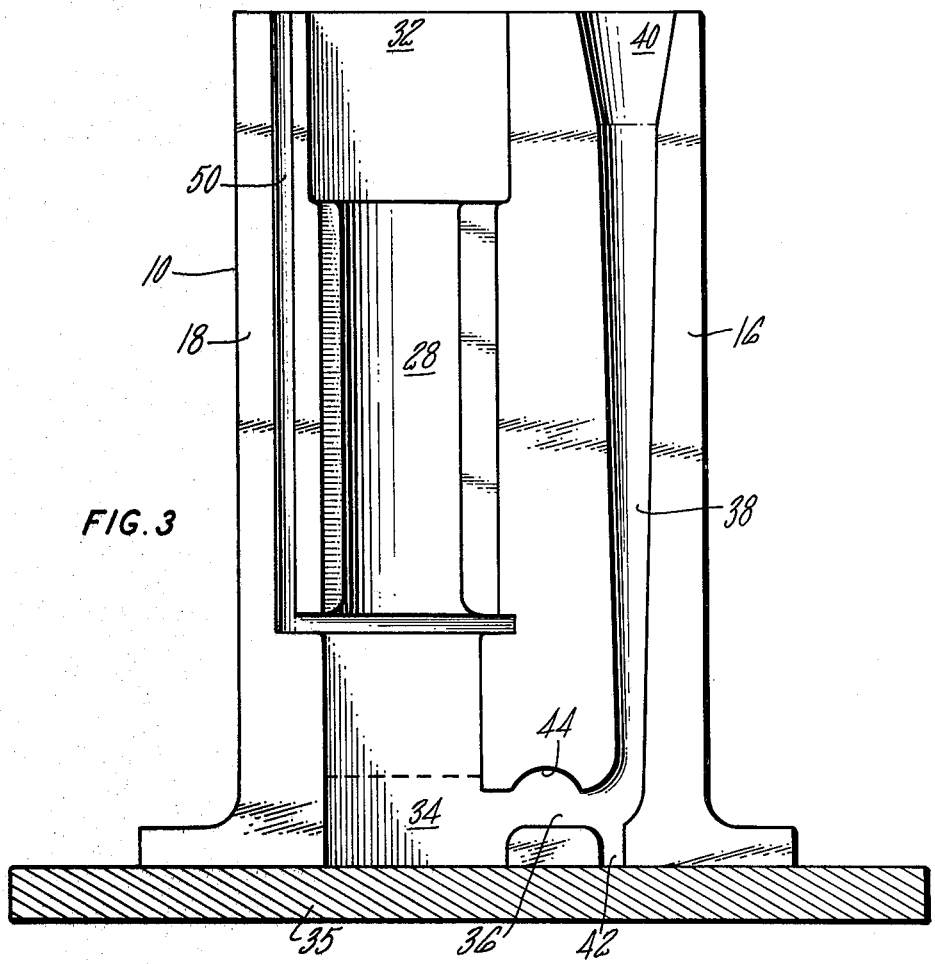
FIG. 3 is an elevation of the inner surface of one of the outer mold elements of FIGS. 1 and 2.

According to the present invention, projecting mating edge flanges 16 and 20 of the outer mold elements also define a complete gating system therebetween when assembled in working relationship, FIG. 2. As shown in FIG. 3, projecting flange 16 has an inner mating surface precast or preformed to define portions of an ingate channel 36, sprue channel 38 and, preferably, a filling cup 40. Of course, mating flange 20 has an inner mating surface defining complementary portions of these same gating system components. The ingate channel communicates at one end with the common growth cavity below the blade half cavities and strongback and with the sprue channel at the other end where they intersect. Traps means, such as inclusion well trap 42 and inclusion riser trap 44, are provided along the length of the ingate channel to remove nonmetallic inclusions and other contaminants from the molten metal prior to entry into the growth cavity. Trap 42 is disposed near the intersection of the ingate channel and sprue channel and functions to remove inclusions carried by molten metal exiting the bottom of the sprue channel whereas trap 44 is positioned near the juncture of the ingate channel and mold cavity and functions to remove similar contaminants carried by the metal exiting the ingate channel. Of course, those skilled in the art will recognize that the number, size, shape and placement of the traps along the ingate channel may be varied as desired to achieve a sound, inclusion-free casting.

The sprue channel which receives molten metal from the filling cup and directs it to the ingate channel is shown as downwardly tapered; that is, having a gradually decreasing cross section in the downward direction. This configuration, as well as others which are well known, is used to control metal flow, including flow rate, to minimize turbulence as the molten metal flows through the ingate channel and into the growth cavity. Of course, those skilled in the art will recognize that the cross-sectional areas of the sprue channel and ingate channel should be in selected proportion to one another to provide optimum molten metal flow characteristics. Such proportion can be readily determined by conventional mathematical and experimental procedures.

Preferably, mating flanges 16 and 20 have inner surfaces which are preformed to define complementary portions of filling cup 40 for receiving molten metal from a ladle, crucible or the like. However, if desired, the filling cup may comprise a separate member which is placed atop the assembled mold. In addition to the gating system components already described, other gating features, such as vent channel 50, may be preformed or precast in the inner surfaces of the mating flanges, such as flanges 18 and 22. Vent channel 50, for instance, may be used to vent gases from the molten metal and thereafter to function as a riser.

The present invention provides an effective solution to the problems associated with filling a preformed, multi-part mold with molten metal. For the first time, a preformed, multi-part mold having a preformed gating system integral therewith for providing smooth, bottom feeding of metal to the mold cavity while simultaneously removing contaminants from the metal is available. Besides providing optimum conditions for grain nucleation and growth, the smooth, bottom feeding of molten metal to the growth cavity minimizes erosion of the mold walls and strongback and the consequent generation of inclusion particles. In addition, the forces generated against a strongback in a three part mold are much reduced, if not eliminated, and breakage thereof is substantially prevented.

Although the invention has been described with reference to the casting of turbine blade halves in a three part mold, it should be understood by those skilled in the art that other article shapes may be readily cast with the aid of the present invention. In addition, it should be recognized that other changes and omissions in the form and detail thereof may be made therein without departing from the spirit and scope of the present invention.

I claim:

1. In a three-part casting mold of the type having a preformed central mold element disposed in spaced relation between preformed opposed outer mold elements to define a mold cavity on each side of the central element, wherein the central element has projecting flanges at its opposite edges which are held at least partially between projecting mating flanges on opposite edges of the outer elements to maintain said spaced relation during casting, the improvement comprising:

outer mold elements having at least one pair of projecting mating flanges which are of extended length in the direction of projection and which extended flanges are preformed to define therebetween gating means for providing smooth, bottom feeding of molten metal to each mold cavity and for simultaneously removing contaminants from the molten metal prior to entry into said cavities, the gating means including:

a. bottom mating portions of said pair of flanges defining an ingate channel in communication at one end with the bottom portion of said cavities for feeding molten metal thereto, the ingate channel extending from the mold cavities in the direction of flange projection and including along its length trap means for removing contaminants from the metal as the metal flows therethrough;

b. the remaining mating portions of said pair of flanges defining an upwardly oriented sprue channel intersecting and in communication with the other end of the ingate channel for directing molten metal therein during filling, the sprue channel having a reduced cross section along its length to control metal flow, including flow rate, so as to minimize turbulence as the metal flows into the ingate channel and then into the mold cavities.

2. The mold of claim 1 wherein top mating portions of said pair of flanges define a filling cup in communication with the sprue channel.

3. The mold of claim 1 wherein the sprue channel has a gradually decreasing cross section in the downward direction.

4. The mold of claim 1 wherein the trap means includes an inclusion well trap near the intersection of the ingate and sprue channels for removing contaminants from molten metal exiting the sprue channel and an inclusion riser trap near the intersection of the ingate channel and mold cavity for removing contaminants from the metal exiting the ingate channel.

* * * * *